US009241214B2

(12) United States Patent
Hashimoto et al.

(10) Patent No.: US 9,241,214 B2
(45) Date of Patent: Jan. 19, 2016

(54) DIRECT SOUND EXTRACTION DEVICE AND REVERBERANT SOUND EXTRACTION DEVICE

(75) Inventors: Takeshi Hashimoto, Motomiya (JP); Tetsuo Watanabe, Hasuda (JP); Toshihiro Fueki, Fujimi (JP)

(73) Assignee: CLARION CO., LTD., Saitama-Shi (JP)

( * ) Notice: Subject to any disclaimer, the term of this patent is extended or adjusted under 35 U.S.C. 154(b) by 178 days.

(21) Appl. No.: 14/112,941

(22) PCT Filed: Jun. 14, 2012

(86) PCT No.: PCT/JP2012/065222

§ 371 (c)(1),
(2), (4) Date: Oct. 21, 2013

(87) PCT Pub. No.: WO2013/005550

PCT Pub. Date: Jan. 10, 2013

(65) Prior Publication Data

US 2014/0044273 A1 Feb. 13, 2014

(30) Foreign Application Priority Data

Jul. 1, 2011 (JP) ..... 2011-147021

(51) Int. Cl.

| | |
|---|---|
| ***H04B 3/20*** | (2006.01) |
| ***H04B 15/00*** | (2006.01) |
| ***H04R 3/02*** | (2006.01) |
| ***G10L 21/0232*** | (2013.01) |
| *G10L 21/0208* | (2013.01) |

(Continued)

(52) U.S. Cl.

CPC ..... *H04R 3/02* (2013.01); *G10L 21/0232* (2013.01); *G10L 2021/02082* (2013.01); *H04R 27/00* (2013.01); *H04R 2227/007* (2013.01); *H04S 7/305* (2013.01)

(58) Field of Classification Search

None

See application file for complete search history.

(56) References Cited

U.S. PATENT DOCUMENTS

2008/0300869 A1* 12/2008 Derkx et al. ..... 704/226
2014/0177857 A1* 6/2014 Kuster ..... 381/66

FOREIGN PATENT DOCUMENTS

JP 2010-74531 4/2010

OTHER PUBLICATIONS

Fukane et al., "Different Approaches of Spectral Subtraction method for Enhancing the Speech Signal in Noisy Enviroments", International Journal of Scientific & Engineering Research, Mar. 1, 2011, vol. 2, Issue 5, XP055172923, see NPL Cite No. 5.

(Continued)

*Primary Examiner* — Andrew L Sniezek
(74) *Attorney, Agent, or Firm* — Mori & Ward, LLP

(57) ABSTRACT

A direct sound extraction device includes: a spectrum transform unit that transforms an input signal, which includes a reverberant sound in a direct sound and on which a Fourier transform process has been performed, to a first amplitude spectrum signal Lfa; a low-pass filter unit (4) that performs a low-pass filtering process on the first amplitude spectrum signal Lfa for each frequency to generate a second amplitude spectrum signal Lfa1; a first subtraction unit (18) that calculates a third amplitude spectrum signal by subtracting the second amplitude spectrum signal Lfa1 from the first amplitude spectrum signal Lfa; and an inverse Fourier transform unit that generates a direct sound signal Lfd from a frequency spectrum signal calculated based on a phase spectrum signal and the third amplitude spectrum signal.

4 Claims, 15 Drawing Sheets

(51) Int. Cl.
*H04R 27/00* (2006.01)
*H04S 7/00* (2006.01)

(56) References Cited

OTHER PUBLICATIONS

Hirsch, "Robust Speech Recognition in Noisy and Reverberant Enviroments", Speech Recognition and Understanding, Recent Advances, Jan. 1, 1992, pp. 101-106, vol. 75, Part 1, XP008175013, see NPL Cite No. 5.
Lebart et al., "A New Method Based on Spectral Subtraction for Speech Dereverberation", ACUSTICA, S. Hirzel Verlag, May 1, 2001, pp. 359-366, vol. 87, No. 3, XP009053193, see NPL Cite No. 5.
Smith, "Chapter 14. Introduction to Digital Filters", The Scientist and Engineer's Guide to Digital Signal Processing, Jan. 1, 2002, pp. 261-276, XP055172473, see NPL Cite No. 5.
Supplementary European Search Report for corresponding EP Application No. 12807065.3, Mar. 11, 2015.
International Search Report for corresponding International Application No. PCT/JP2012/065222, Jul. 10, 2012.
Chinese Office Action for corresponding CN Application No. 201280015523.2, Nov. 4, 2014.

* cited by examiner

DIRECT SOUND EXTRACTION DEVICE AND REVERBERANT SOUND EXTRACTION DEVICE

TECHNICAL FIELD

The present invention relates to a direct sound extraction device and a reverberant sound extraction device, and more particularly to a direct sound extraction device that can extract a direct sound from an input signal containing a reverberant sound, and a reverberant sound extraction device that can extract a reverberant sound from the input signal.

BACKGROUND ART

If music, speeches, and the like are played in an environment where reverberation can easily occur, such as halls, and are recorded, the recorded acoustic signals often contain not only a direct sound but also a reverberant sound, which is convoluted in during the recording. Therefore, if the acoustic signals into which the reverberant sound has been convoluted are played in another acoustic environment, there is a reduction in the clarity of the direct sound, possibly making it very difficult to listen when the acoustic signals are played.

If a speech sound into which a reverberant sound has been convoluted is used for voice recognition or the like, the problem is that the recognition rate of the speech sound (content) would decrease due to a reduction in the clarity caused by the reverberant sound.

As for the acoustic signals into which the reverberant sound has been convoluted as described above, a conventional technique has been known to reduce the reverberant sound (See Patent Literature 1, for example). The use of the technique makes it possible to clarify the direct sound by reducing the reverberant sound.

CITATION LIST

Patent Literature

Patent Literature 1: JP-A-2010-74531

SUMMARY OF INVENTION

Technical Problem

However, according to the method described in Patent Literature 1, in order to reduce the reverberant sound contained in an input signal, various types of signal processing need to be carried out, such as a pseudo-whitening process, a multi-step linear prediction process, and a rear reverberation prediction process and the like. Therefore, a lot of processing load is required. Accordingly, to actually reduce the reverberant sound, high-powered devices, such as microprocessors or digital signal processors, are required. The problem is that, in terms of cost and other factors, the method of Patent Literature 1 easily cannot be used without being changed.

The present invention has been made in view of the above problems. The object of the present invention is to provide a direct sound extraction device and reverberant sound extraction device that can easily extract a direct sound or a reverberant sound from an acoustic signal containing the reverberant sound.

Solution to Problem

According to the present invention, a direct sound extraction device includes: a Fourier transform unit which performs a Fourier transform process on an input signal that includes a reverberant sound in a direct sound; a spectrum transform unit which transforms, on the basis of frequency spectra of real and imaginary numbers of the input signal on which a Fourier transform process has been performed by the Fourier transform unit, the input signal to a first amplitude spectrum signal and a phase spectrum signal; a low-pass filter unit which carries out a low-pass filtering process on the first amplitude spectrum signal by using a preset normalized cutoff frequency for each frequency; a first limiter unit which limits a negative side of an amplitude of a second amplitude spectrum signal on which a low-pass filtering process has been performed by the low-pass filter unit, so as to bring the amplitude to zero; a first subtraction unit which calculates a third amplitude spectrum signal by subtracting the second amplitude spectrum signal whose negative-side amplitude has been limited by the first limiter unit from the first amplitude spectrum signal; a second limiter unit which limits a negative side of an amplitude of the third amplitude spectrum signal calculated by the first subtraction unit, so as to bring the amplitude to zero; an inverse spectrum transform unit which calculates, on the basis of the phase spectrum signal and the third amplitude spectrum signal whose negative-side amplitude has been limited by the second limiter unit, a signal that is made from frequency spectra of real and imaginary numbers; and an inverse Fourier transform unit which performs an inverse Fourier transform process on the signal calculated by the inverse spectrum transform unit to generate a direct sound signal that is obtained by extracting the direct sound from the input signal.

The direct sound extraction device of the present invention performs Fourier transform of an input signal that includes a reverberant sound in a direct sound, and uses a preset normalized cutoff frequency to carry out a low-pass filtering process on a first amplitude spectrum signal calculated by the spectrum transform unit. In this manner, the direct sound extraction device calculates a signal that is integrated for each spectrum (Integral signal: second amplitude spectrum signal). The signal thus integrated is the equivalent of a spectrum signal that constitutes a stationary component in the time change of the input signal, i.e. a reverberant sound signal.

Accordingly, a third amplitude spectrum signal that the first subtraction unit calculates by subtracting the second amplitude spectrum signal from the first amplitude spectrum signal is a signal that is obtained by subtracting a reverberant sound from an input signal. The process makes it possible to calculate a signal that is the equivalent of a direct sound signal.

Therefore, a signal that is generated by the inverse spectrum transform unit and the inverse Fourier transform unit is a signal that is obtained by extracting a direct sound from the input signal. As a result, from the input signal that includes a reverberant sound in a direct sound, the direct sound can be easily extracted.

Furthermore, by adjusting the normalized cutoff frequency, it is possible to adjust an extraction time of the direct sound contained in the input signal. As the value of the normalized cutoff frequency becomes smaller, the extraction time of the direct sound contained in the input signal becomes longer, enabling extraction of the direct sound in such a way as to contain not only a non-stationary sound but also a stationary sound. Since the direct sound is extracted in such a way as to contain a stationary sound, it is possible to add such properties as tone colors and ease of listening to the direct sound, compared with a direct sound not containing a stationary sound at all. When a listener listens to the direct sound, the listener can recognize the direct sound as a sound without a feeling of strangeness.

Advantageous Effects of Invention

The direct sound extraction device of the present invention can easily extract the direct sound from the input signal that includes the reverberant sound in the direct sound. The reverberant sound extraction device of the present invention can easily extract the reverberant sound from the input signal that includes the reverberant sound in the direct sound.

BRIEF DESCRIPTION OF DRAWINGS

FIG. 4(*b*) shows one example of filter coefficients for each amplitude spectrum in a HPF unit.

FIG. 5(*b*) is a diagram showing one example of frequency changes of an amount of weighting of amplification and attenuation of a second gain unit according to an embodiment of the present invention.

FIG. 15(*b*) is a diagram schematically showing a state in which the waveform of a reverberant sound signal shown in FIG. 14 varies according to how the value of a normalized cutoff frequency is adjusted, and an input signal.

DESCRIPTION OF EMBODIMENTS

The following shows an acoustic processing device, which is an example of a direct sound extraction device and reverberant sound extraction device of the present invention. The acoustic processing device will be described in detail with reference to the accompanying drawings.

Incidentally, when a reverberant sound is convoluted into a direct sound such as voice or instrumental sound, a stationary signal corresponding to a reverberation time is added to the non-stationary signal such as voice and instrumental sound in a frequency spectrum. The acoustic processing device of the present embodiment extracts or separates a non-stationary signal from an input signal to extract a direct sound; and extracts or separates a stationary signal from an input signal to extract a reverberant sound.

Figure 1:
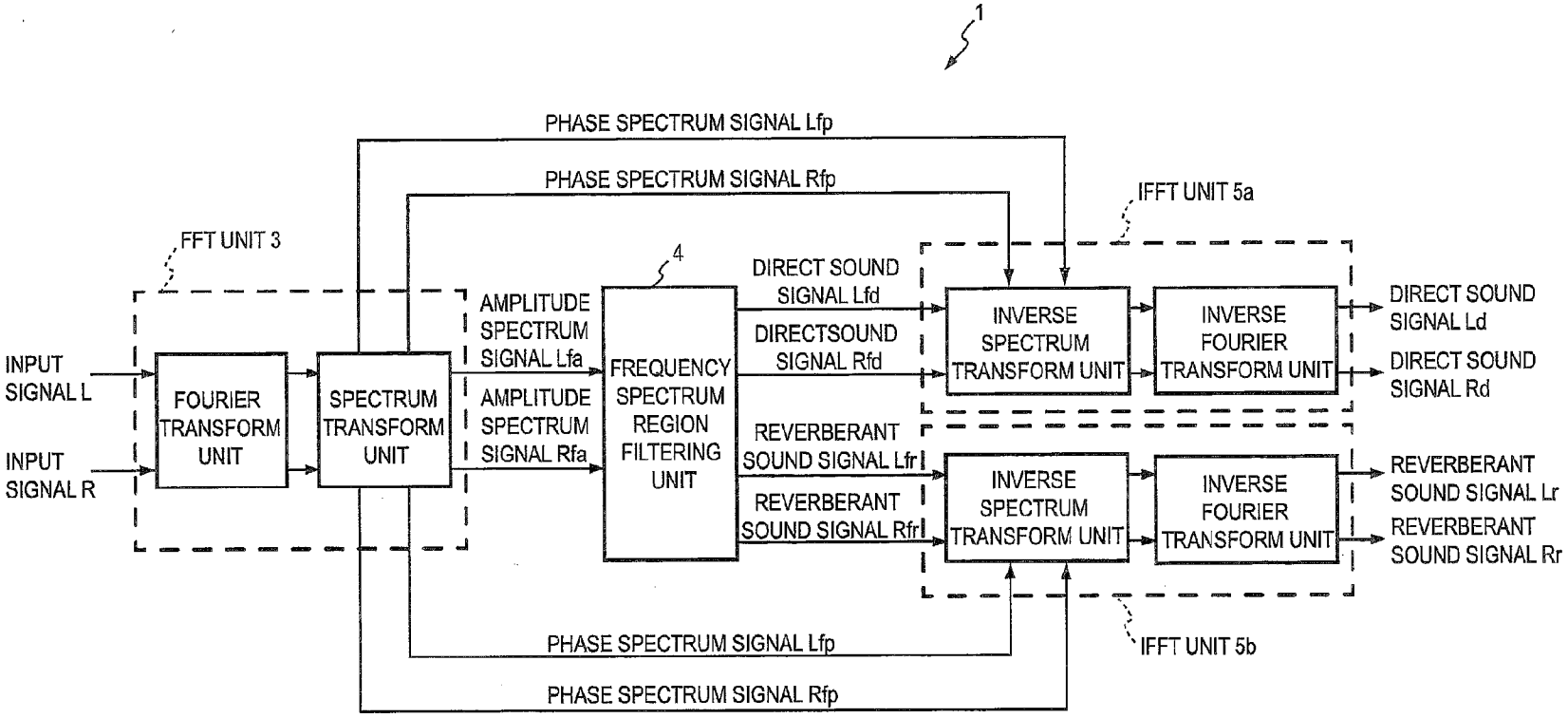
FIG. 1 is a block diagram showing, as one example, the schematic configuration of an acoustic processing device according to an embodiment of the present invention.

FIG. 1 is a block diagram showing the schematic configuration of the acoustic processing device. As shown in FIG. 1, the acoustic processing device 1 includes an FFT unit (a Fourier transform unit and a spectrum transform unit) 3, a frequency spectrum region filtering unit 4, and IFFT units (an inverse Fourier transform unit and an inverse spectrum transform unit) 5*a* and 5*b*.

Into the FFT unit 3, two-channel input signals L and R (L-channel and R-channel) are input from a sound source unit not shown in the diagram: In the two-channel input signals L and R, a reverberant sound (e.g. a reflected sound in a speech) is convoluted into (or contained in) a direct sound (e.g. voice such as speech). The FFT unit 3 is designed to use a window function to weight each of the two-channel input signals L and R into which the reverberant sound has been convoluted.

Figure 2:
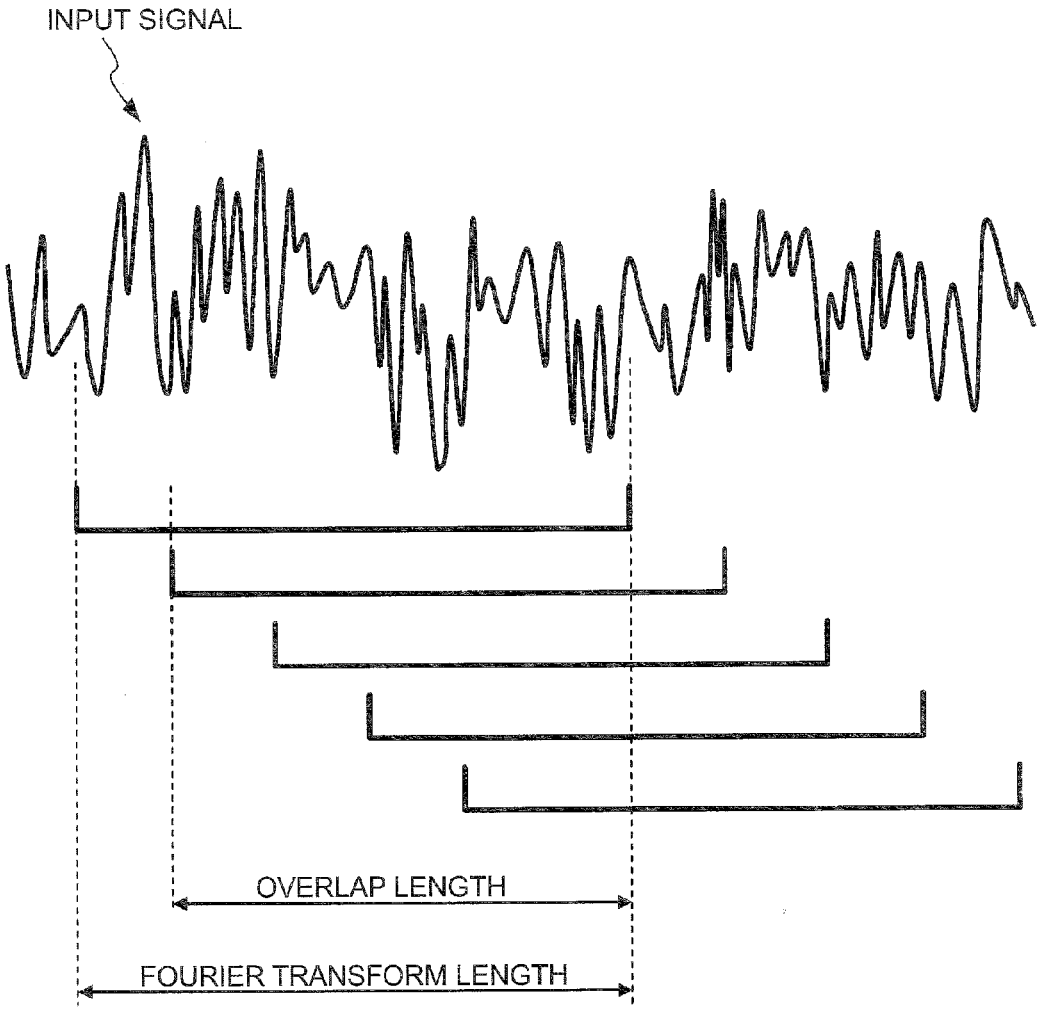
FIG. 2 is a diagram schematically showing Fourier transform length and overlap length when a short-time Fourier transform process is performed on an input signal in an FFT unit according to an embodiment of the present invention.

After having used the window function to weight, the FFT unit 3 performs a short-time Fourier transform process on each of the input signals L and R, thereby transforming the input signals L and R from a time domain to a frequency domain and calculating frequency spectra of real and imaginary numbers. FIG. 2 is a diagram schematically showing Fourier transform length and overlap length when a short-time Fourier transform process is performed on an input signal L (or input signal R) in the FFT unit 3. In this case, because the FFT unit 3 performs a Fourier transform process on the input signals, the FFT unit 3 works as a Fourier transform unit of the present invention.

Furthermore, the FFT unit 3 transforms two-channel frequency spectra, which are calculated by frequency-region conversion, to amplitude spectrum signals Lfa and Rfa (first amplitude spectrum signals) and phase spectrum signals Lfp and Rfp. Then, the FFT unit 3 outputs the transformed two-channel amplitude spectrum signals Lfa and Rfa to the frequency spectrum region filtering unit 4. Moreover, the FFT unit 3 outputs the two-channel phase spectrum signals Lfp and Rfp to the IFFT unit 5*a* and the IFFT unit 5*b*. In this case, the FFT unit 3 transforms the input signals to the amplitude spectrum signals Lfa and Rfa and the phase spectrum signals Lfp and Rfp. Therefore, the FFT unit 3 works as a spectrum transform unit of the present invention.

Figure 3:
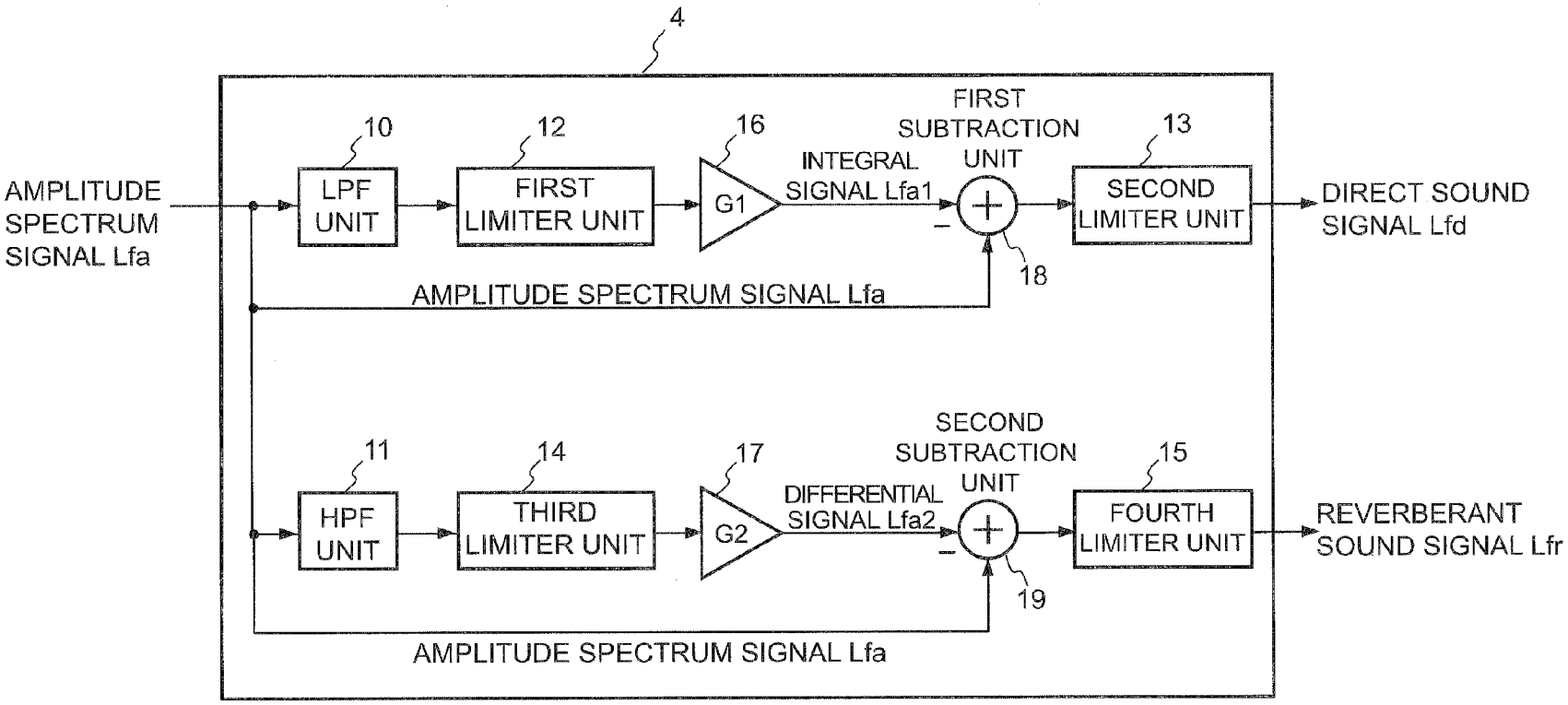
FIG. 3 is a block diagram showing, as one example, the schematic configuration of a frequency spectrum region filtering unit according to an embodiment of the present invention.

FIG. 3 is a block diagram showing the schematic configuration of the frequency spectrum region filtering unit 4. The frequency spectrum region filtering unit 4 is designed to extract non-stationary and stationary signals by carrying out a simple filtering process for each spectrum. Incidentally, in the process by the frequency spectrum region filtering unit 4, a filtering process is performed only on the amplitude spectrum signals Lfa and Rfa, and no filtering process is performed on the phase spectrum signals Lfp and Rfp.

As shown in FIG. 3, the frequency spectrum region filtering unit 4 includes a LPF unit (low-pass filter unit) 10, a HPF unit (high-pass filter unit) 11, a first limiter unit 12, a second limiter unit 13, a third limiter unit 14, a fourth limiter unit 15, a first gain unit 16, a second gain unit 17, a first subtraction unit 18, and a second subtraction unit 19. FIG. 3 shows only the functional units (the LPF unit 10, the HPF unit 11, the limiter units 12 to 15, the gain units 16 and 17, and the subtraction units 18 and 19) designed to perform processes on the amplitude spectrum signal Lfa. FIG. 3 does not show the functional units designed to perform processes on the amplitude spectrum signal Rfa. However, similar functional units are so provided as to perform processes on the amplitude spectrum signal Rfa, and similar filtering processes are carried out.

The LPF unit 10 is designed to perform, on the basis of a predetermined normalized cutoff frequency, a low-pass filtering process for each spectrum (each frequency) on the amplitude spectrum signal Lfa that is input from the FFT unit 3. The first limiter unit 12 is designed to limit the negative-side amplitude of the amplitude spectrum signal (second amplitude spectrum signal) on which the low-pass filtering process has been performed by the LPF unit 10, thereby bringing the amplitude to zero. The first gain unit 16 is designed to amplify or attenuate the amplitude of the amplitude spectrum signal whose negative-side amplitude has been limited. In this manner, in the LPF unit 10, the low-pass filtering process is carried out on the amplitude spectrum signal Lfa. As a result, a signal (integral signal: second amplitude spectrum signal) Lfa1 that has been integrated for each spectrum is generated.

The first subtraction unit 18 subtracts, from the amplitude spectrum signal Lfa that is input from the FFT unit 3, the integral signal Lfa1 that is input from the first gain unit 16, thereby calculating a non-stationary spectrum signal (third amplitude spectrum signal) that changes with time. Then, the second limiter unit 13 limits the negative-side amplitude of the spectrum signal (third amplitude spectrum signal) calculated by the first subtraction unit 18, thereby bringing the amplitude to zero. The signal whose amplitude has been limited by the second limiter unit 13 is output as a direct sound signal Lfd to the IFFT unit 5*a*.

The HPF unit 11 is designed to perform, on the basis of a predetermined normalized cutoff frequency, a high-pass filtering process for each spectrum (each frequency) on the amplitude spectrum signal Lfa that is input from the FFT unit 3. The third limiter unit 14 is designed to limit the negative-side amplitude of the amplitude spectrum signal on which the high-pass filtering process has been performed by the HPF unit 11, thereby bringing the amplitude to zero. The second gain unit 17 is designed to amplify or attenuate the amplitude of the amplitude spectrum signal whose negative-side amplitude has been limited. In this manner, in the HPF unit 11, the high-pass filtering process is carried out on the amplitude spectrum signal Lfa. As a result, a signal (differential signal) Lfa2 that has been differentiated for each spectrum is generated.

The second subtraction unit 19 subtracts, from the amplitude spectrum signal Lfa that is input from the FFT unit 3, the differential signal Lfa2 that is input from the second gain unit 17, thereby calculating a stationary spectrum signal that slightly changes with time. Then, the fourth limiter unit 15 limits the negative-side amplitude of the spectrum signal calculated by the second subtraction unit 19, thereby bringing the amplitude to zero. The signal whose amplitude has been limited by the fourth limiter unit 15 is output as a reverberant sound signal Lfr to the IFFT unit 5*b*.

Incidentally, the normalized cutoff frequency of a low-pass filter of each amplitude spectrum in the LPF unit 10, and the normalized cutoff frequency of a high-pass filter of each amplitude spectrum in the HPF unit 11 are those used to adjust the division time of the direct sound and reverberant sound (or those used to adjust the extraction time of the direct sound, and to adjust the extraction time of the reverberant sound). Moreover, in the first gain unit 16 and the second gain unit 17, by changing an amount of weighting of amplification and attenuation, it becomes possible to adjust a blend ratio of the direct sound and reverberant sound (or to adjust the percentage of the reverberant sound contained in the direct sound, as well as to adjust the percentage of the direct sound contained in the reverberant sound).

Figure 4:
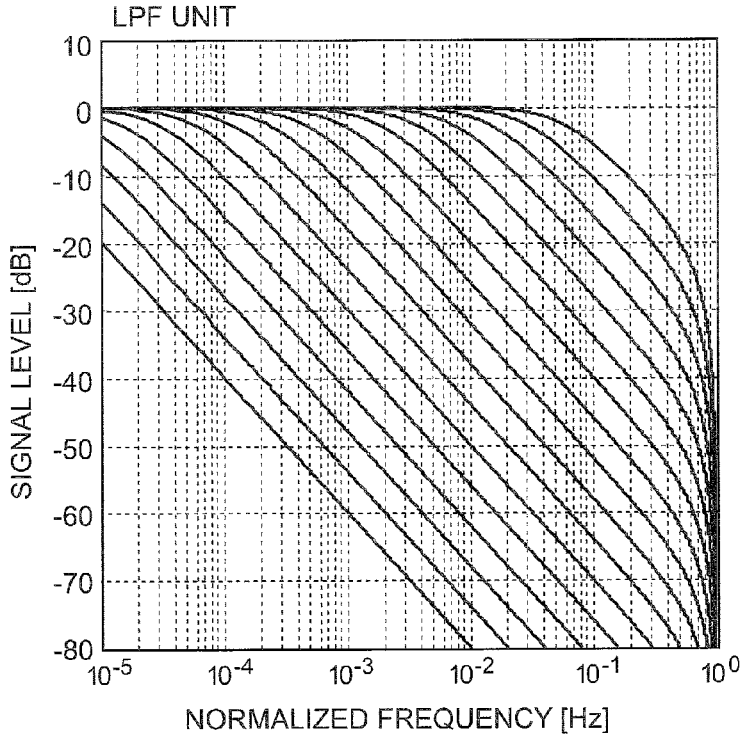
FIG. 4(*a*) shows one example of filter coefficients for each amplitude spectrum in a LPF unit according to an embodiment of the present invention.
Figure 4:
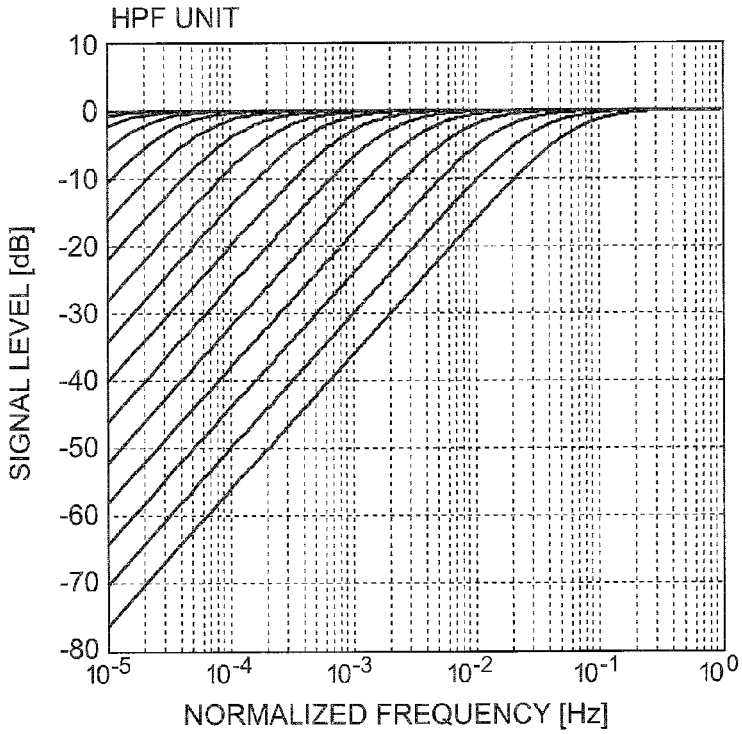

FIG. 4(*a*) shows one example of filter coefficients for each amplitude spectrum in the LPF unit 10 according to the present embodiment. FIG. 4(*b*) shows one example of filter coefficients for each amplitude spectrum in the HPF unit 11 according to the present embodiment. The LPF unit 10 and HPF unit 11 shown in FIGS. 4(*a*) and 4(*b*) are first-order Butterworth filters. As shown in FIG. 4, the normalized cutoff frequency of the LPF unit 10 and the HPF unit 11 is changed to 0.000001, 0.000002, 0.000004 . . . and 0.0655. As the value of the cutoff frequency becomes smaller, the extraction time of the direct sound and the extraction time of the reverberant sound become longer. Incidentally, in the frequency spectrum region filtering unit 4 of the present embodiment, the cutoff frequencies of the LPF unit 10 and the HPF unit 11 are so set as to be the same across the amplitude spectra. However, the cutoff frequencies of the LPF unit 10 and the HPF unit 11 may be set independently for each amplitude spectrum.

Figure 5:
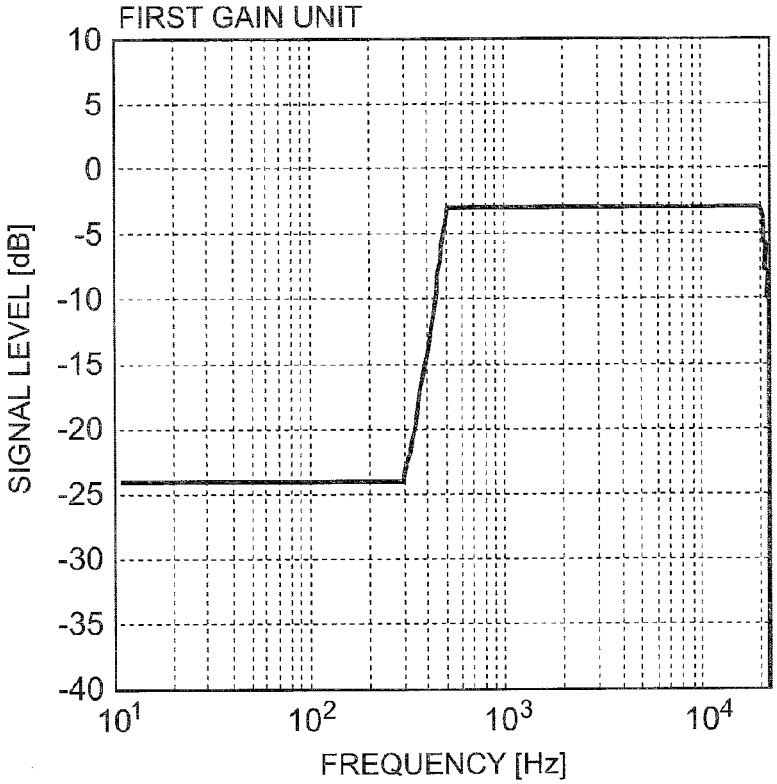
FIG. 5(*a*) is a diagram showing one example of frequency changes of an amount of weighting of amplification and attenuation of a first gain unit according to an embodiment of the present invention.
Figure 5:
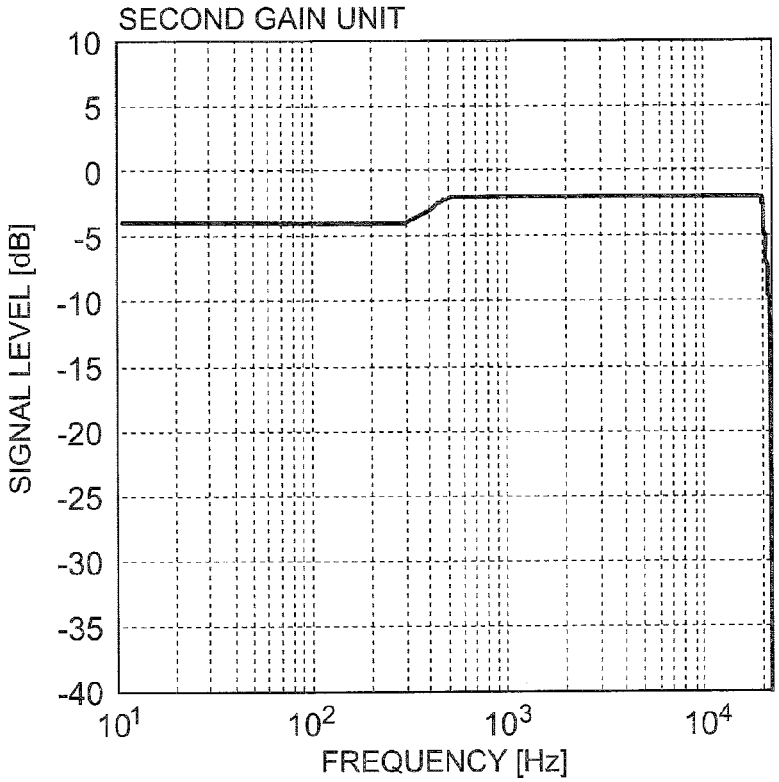

FIG. 5(*a*) is a diagram showing one example of frequency changes of an amount of weighting of amplification and attenuation of the first gain unit 16 according to the present embodiment. FIG. 5(*b*) is a diagram showing one example of frequency changes of an amount of weighting of amplification and attenuation of the second gain unit 17. As shown in FIGS. 5(*a*) and 5(*b*), in the first gain unit 16 and second gain unit 17 of the present embodiment, as the gain (signal level) becomes smaller, the mixed quantity becomes larger. Moreover, as shown in FIGS. 5(*a*) and 5(*b*), in the direct sound-side first gain unit 16, at an amplitude spectrum of 500 Hz or less, the separation of the direct sound and the reverberant sound is hardly carried out.

FIGS. 6 to 9 show an example of operation of each part of the frequency spectrum region filtering unit 4, and are diagrams showing, as an example, time changes of the amplitude of an input signal (amplitude spectrum signal Lfa) that is input into the frequency spectrum region filtering unit 4, the amplitude of the integral signal Lfa1, the amplitude of the differential signal Lfa2, the amplitude of the direct sound signal Lfd, and the amplitude of the reverberant sound signal Lfr. The waveforms shown in FIGS. 6 to 9 all are the results of observing the time changes of an amplitude spectrum around 1 kHz.

Figure 6:
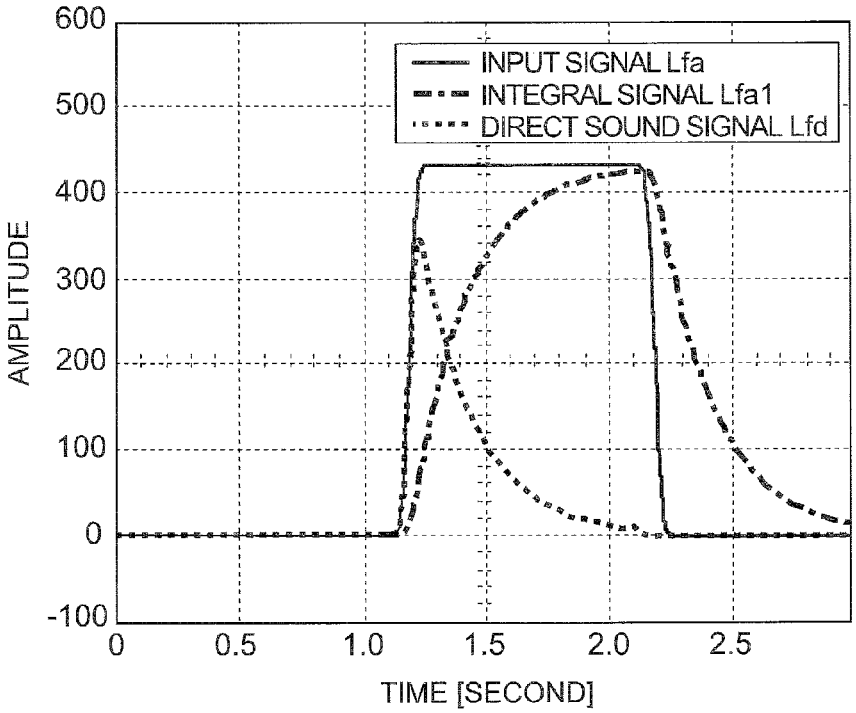
FIG. 6 is a first diagram showing, as an example, time changes of the amplitude of an input signal that is input into a frequency spectrum region filtering unit, the amplitude of an integral signal Lfa1, the amplitude of a differential signal Lfa2, the amplitude of a direct sound signal Lfd, and the amplitude of a reverberant sound signal Lfr according to an embodiment of the present invention.
Figure 6:
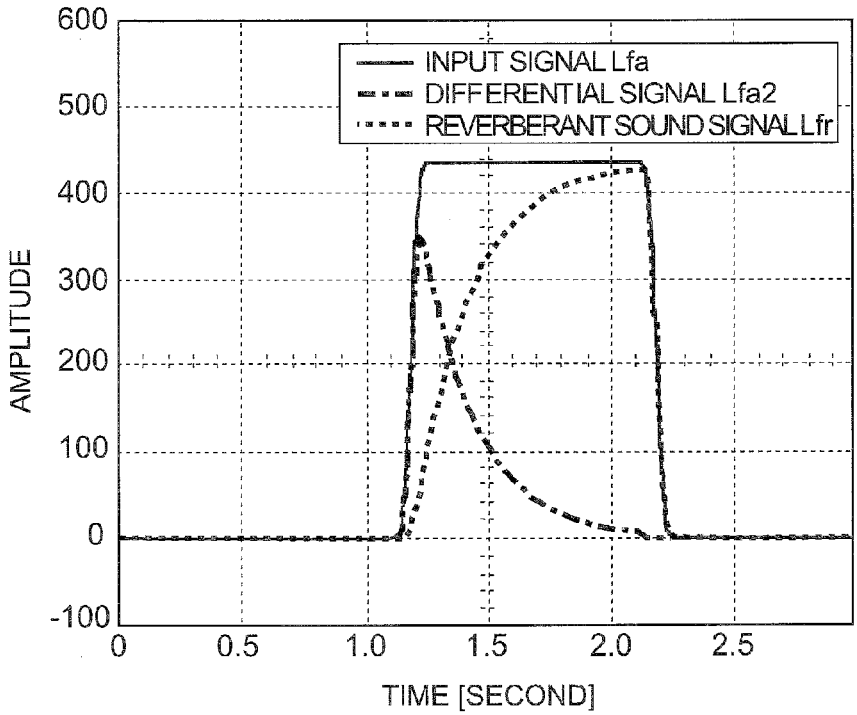
Figure 7:
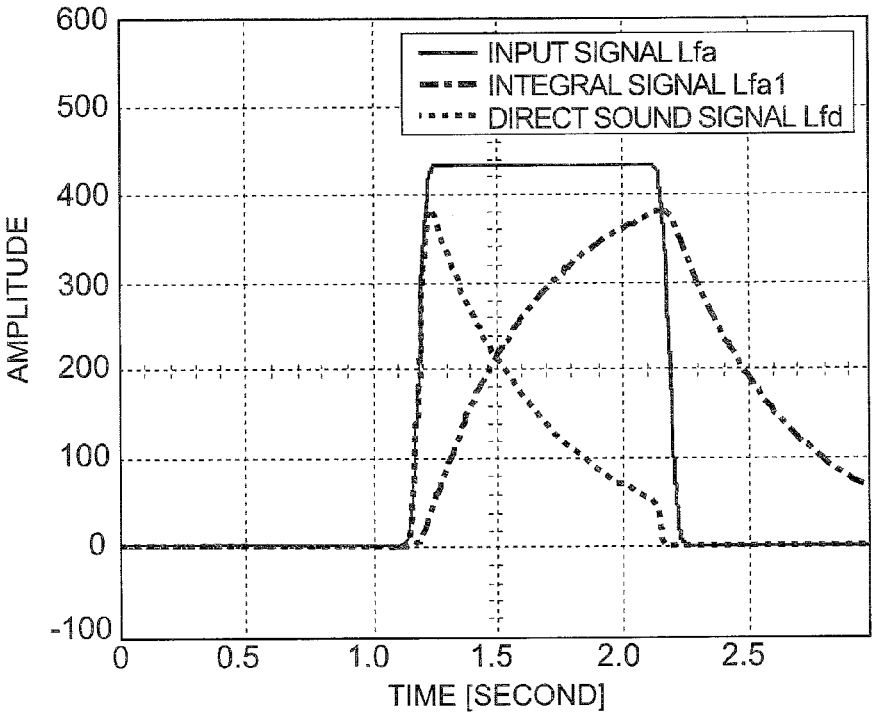
FIG. 7 is a second diagram showing, as an example, time changes of the amplitude of an input signal that is input into a frequency spectrum region filtering unit, the amplitude of an integral signal Lfa1, the amplitude of a differential signal Lfa2, the amplitude of a direct sound signal Lfd, and the amplitude of a reverberant sound signal Lfr according to an embodiment of the present invention.
Figure 7:
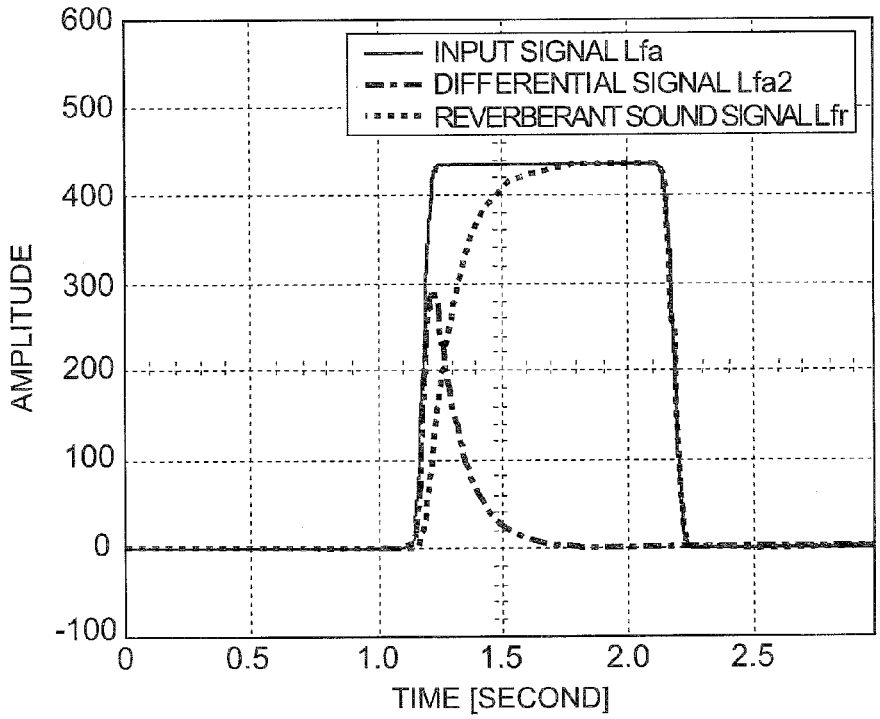
Figure 8:
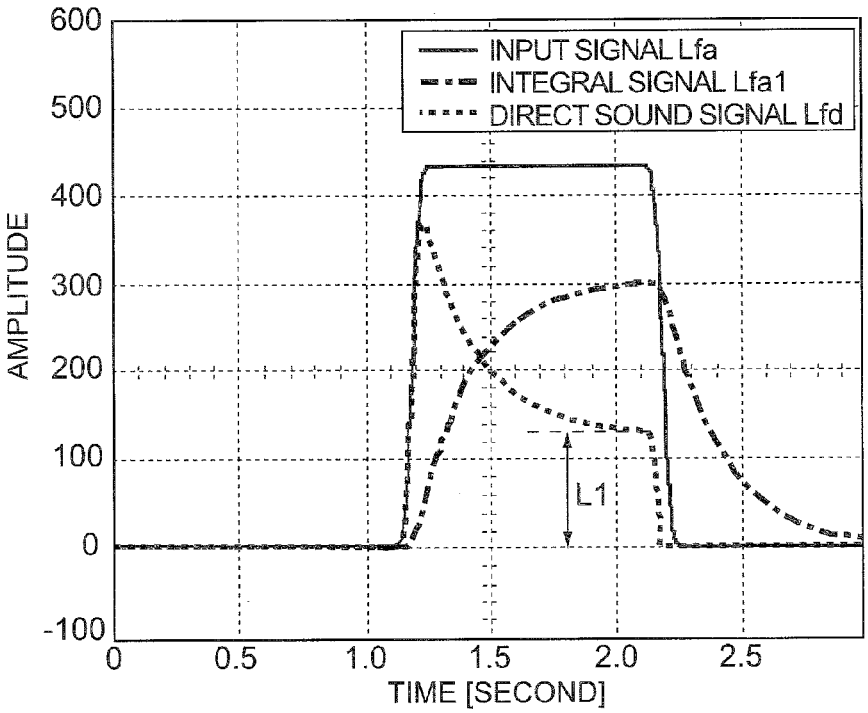
FIG. 8 is a third diagram showing, as an example, time changes of the amplitude of an input signal that is input into a frequency spectrum region filtering unit, the amplitude of an integral signal Lfa1, the amplitude of a differential signal Lfa2, the amplitude of a direct sound signal Lfd, and the amplitude of a reverberant sound signal Lfr according to an embodiment of the present invention.
Figure 8:
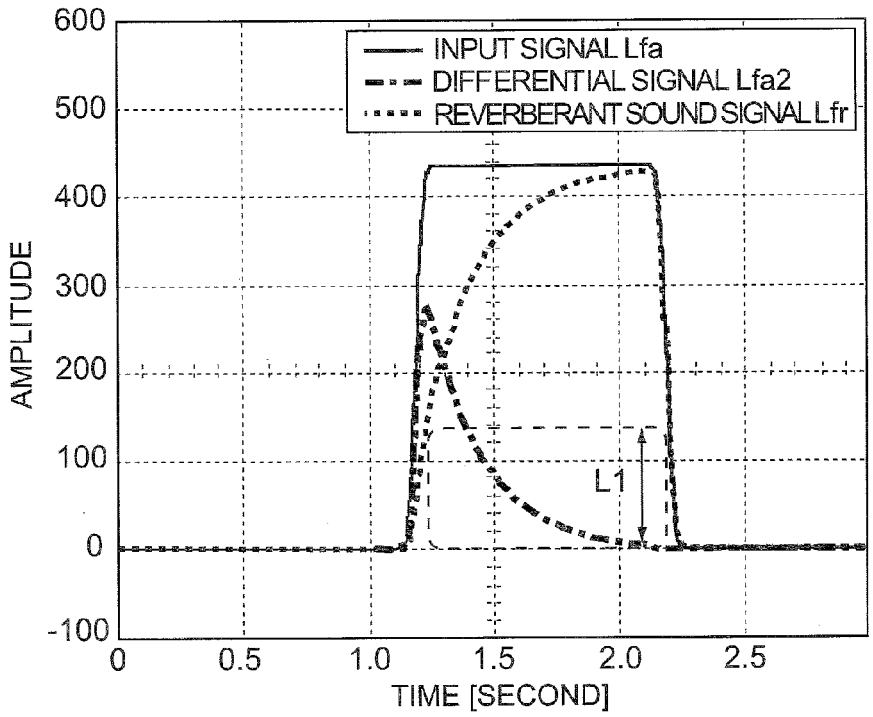
Figure 9:
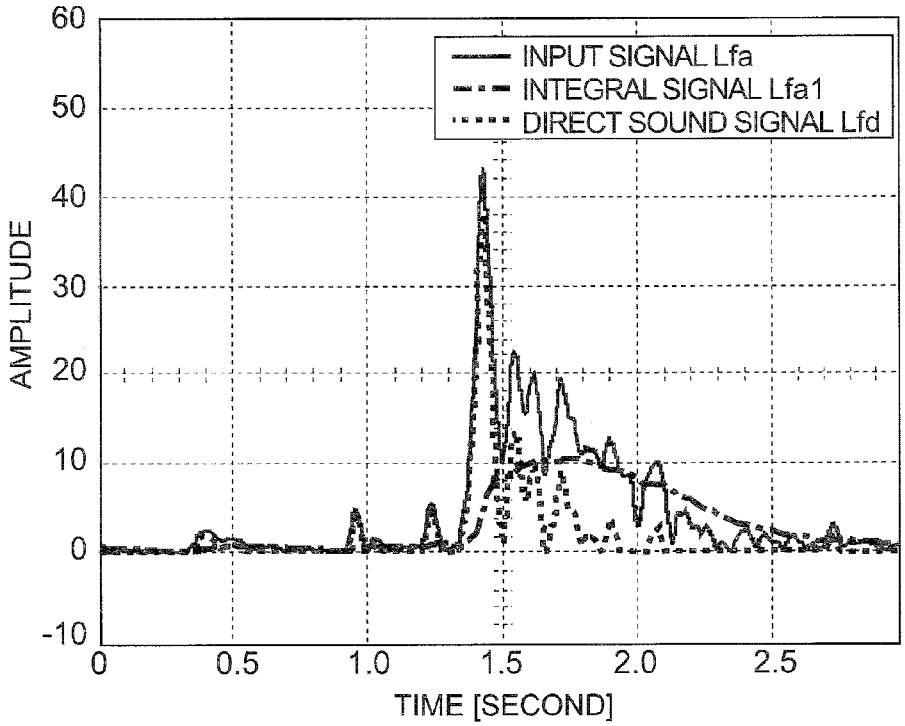
FIG. 9 is a fourth diagram showing, as an example, time changes of the amplitude of an input signal that is input into a frequency spectrum region filtering unit, the amplitude of an integral signal Lfa1, the amplitude of a differential signal Lfa2, the amplitude of a direct sound signal Lfd, and the amplitude of a reverberant sound signal Lfr according to an embodiment of the present invention.
Figure 9:
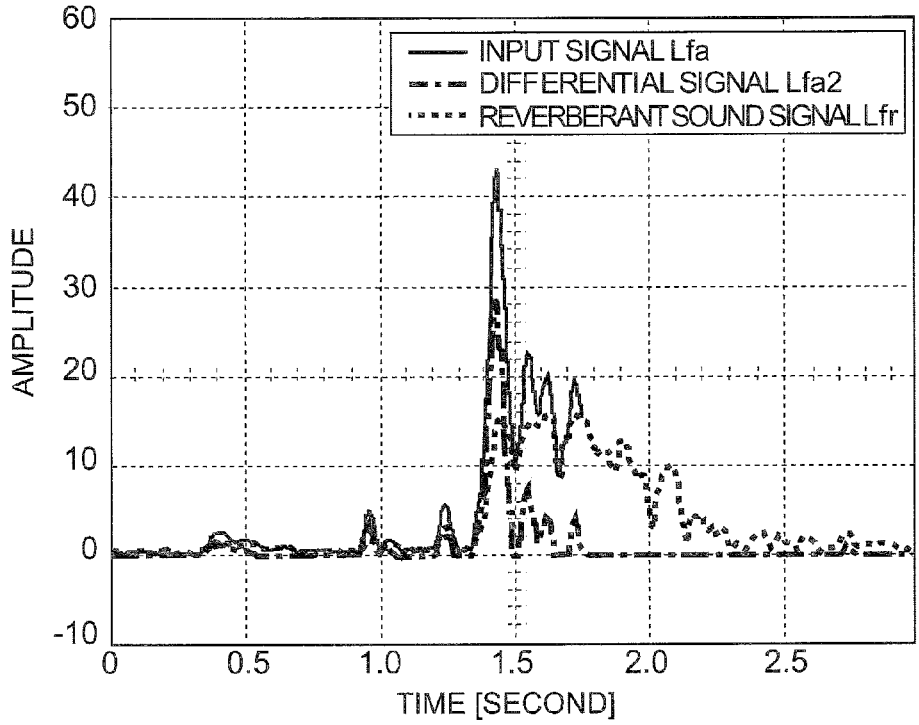

Incidentally, in the example of operation shown in FIGS. 6 to 9, a sampling rate of the input signal is 44.1 kHz, the Fourier transform length of the FFT unit 3 is 4096 samples, the overlap length is 3840 samples, which is fifteen-sixteenths of the Fourier transform length, and the window function of the Fourier transform is Blackman. The input signals shown in FIGS. 6 to 8 are sine waves of 1 kHz with a reproduction time of 1 second. The input signals shown in FIG. 9 are of music.

What is shown in FIGS. 8 and 9 is the case where weighting is carried out for each of the spectra (each of the frequencies) shown in FIGS. 5(*a*) and 5(*b*) in the first gain unit 16 and the second gain unit 17. What is shown in FIGS. 6 and 7 is the case where weighting is not carried out in the first gain unit 16 and the second gain unit 17, with the gain (signal level) for all amplitude spectra set to 0 dB.

First, for a direct sound-side signal shown in FIG. 6(*a*), the LPF unit 10 performs a low-pass filtering process to carry out an integration process of the input signal Lfa having a rectangular shape. Accordingly, a rising portion of the rectangular input signal Lfa is extracted, and an integral signal Lfa1 whose amplitude rises gradually is generated. After that, in the first subtraction unit 18, the integral signal Lfa1 is subtracted from the input signal Lfa. Therefore, from the rectangular shape of the input signal Lfa, the amplitude of the gradually-rising portion of the integral signal Lfa1 is subtracted. As a result, the rising portion of the rectangular signal, i.e. non-stationary component, is extracted as a direct sound signal Lfd.

Incidentally, the subtraction process by the first subtraction unit 18 makes the amplitude of the direct sound signal Lfd negative. However, since the amplitude has been limited by the second limiter unit 13 and brought to zero, as shown in FIG. 6(*a*), the value of the direct sound signal Lfd is not negative.

Then, for a reverberant sound-side signal shown in FIG. 6(*b*), the HPF unit 11 performs a high-pass filtering process to carry out a differential process of the input signal Lfa having a rectangular shape. Accordingly, a differential signal Lfa2, which has a sharp rising portion of the rectangular input signal Lfa and a subsequent gradually-attenuating portion, is generated. After that, in the second subtraction unit 19, the differential signal Lfa2 is subtracted from the input signal Lfa. Therefore, from the rectangular shape of the input signal Lfa, the amplitudes of the sharp rising portion of the differential signal Lfa2 and the like are subtracted. As a result, a portion other than the rising portions of the rectangular signal, i.e. stationary component, is extracted as a reverberant sound signal Lfr.

Incidentally, the subtraction process by the second subtraction unit 19, too, makes the amplitude of the reverberant sound signal Lfr negative. However, since the amplitude has been limited by the fourth limiter unit 15 and brought to zero, as shown in FIG. 6(*b*), the value of the reverberant sound signal Lfr is not negative.

FIG. 7 is a diagram showing the case in which the normalized cutoff frequencies of the HPF unit 11 and the LPF unit 10 are changed in the situation shown in FIG. 6. More specifically, the normalized cutoff frequency of the HPF unit 11 shown in FIG. 7(*b*) is set to 0.0041, which is a value lower than the normalized cutoff frequency, 0.0082, of the HPF unit 11 shown in FIG. 6(*b*). The normalized cutoff frequency of the LPF unit 10 shown in FIG. 7(*a*) is set to 0.0164, which is a value higher than the normalized cutoff frequency, 0.0082, of the LPF unit 10 shown in FIG. 6(*a*).

As shown in FIGS. 6 and 7, as the normalized cutoff frequencies become lower, the response of filters become slower, and the response of rising of signals become longer. As the normalized cutoff frequencies become higher, the response of filters become faster, and the response of rising of signals become shorter. In that manner, the cutoff frequencies are adjusted, and thus it is possible to adjust the division time of the direct sound and reverberant sound (or to adjust the extraction time of the direct sound, and to adjust the extraction time of the reverberant sound).

FIG. 8 is a diagram showing the case in which an amount of weighting for each spectrum in the first gain unit 16 and the second gain unit 17 is set in the situation shown in FIG. 6. As the amount of weighting is set, an offset (or raising of amplitude) is generated according to the amount of weighting in the direct sound and reverberant sound. Therefore, to a direct sound signal Lfd shown in FIG. 8(*a*), a reverberant sound associated with the offset is added (raising of amplitude with a height of L1 as shown in FIG. 8(*a*)). To a reverberant sound signal Lfr shown in FIG. 8(*b*), a direct sound associated with the offset is added (raising of amplitude with a height of L1 as shown in FIG. 8(*b*)). In that manner, with the help of the offset that is generated as the amount of weighting is set, it is possible to adjust the blend ratio of the direct sound and reverberant sound (or to adjust the percentage of the reverberant sound contained in the direct sound, as well as to adjust the percentage of the direct sound contained in the reverberant sound).

FIG. 9 is a diagram showing the case in which, in the situation shown in FIG. 8, an input signal is of a music signal, and components around 1 kHz that attenuate with time are extracted. As shown in FIG. 9(*a*), as for a direct sound-side signal, a signal of direct sound is extracted in the first half in which the amplitude is large. As shown in FIG. 9(*b*), as for a reverberant sound-side signal, a signal of reverberant sound is extracted in the latter half in which the amplitude of an input signal is attenuated.

The IFFT unit 5*a* converts, on the basis of the amplitude spectrum signals (direct sound signals Lfd and Rfd) that are made from the direct sound filtered by the frequency spectrum region filtering unit 4 and the phase spectrum signals Lfp and Rfp acquired from the FFT unit 3, to frequency spectra of real and imaginary numbers; and carries out a process of weighting by using a window function. Then, the IFFT unit 5*a* performs a short-time inverse Fourier transform process and an overlap addition process on a signal on which the weighting process has been performed, thereby converting the signal from the frequency domain to the time domain and generating direct sound signals Ld and Rd that are made from the direct sound.

Similarly, the IFFT unit 5*b* converts, on the basis of the amplitude spectrum signals (reverberant sound signals Lfr and Rfr) that are made from the reverberant sound filtered by the frequency spectrum region filtering unit 4 and the phase spectrum signals Lfp and Rfp acquired from the FFT unit 3, to frequency spectra of real and imaginary numbers; and carries out a process of weighting by using a window function. Then, the IFFT unit 5*b* performs a short-time inverse Fourier transform process and an overlap addition process on a signal on which the weighting process has been performed, thereby converting the signal from the frequency domain to the time domain and generating reverberant sound signals Lr and Rr that are made from the reverberant sound.

Incidentally, the IFFT units 5*a* and 5*b* carry out, on the basis of the amplitude spectrum signals and the phase spectrum signals, a process of converting to frequency spectra of real and imaginary numbers. Therefore, the IFFT units 5*a* and 5*b* correspond to an inverse spectrum transform unit of the present invention. Furthermore, the IFFT units 5*a* and 5*b* carry out a short-time inverse Fourier transform process on a signal on which the weighting process has been performed. Therefore, the IFFT units 5*a* and 5*b* correspond to an inverse Fourier transform unit of the present invention.

Figure 10:
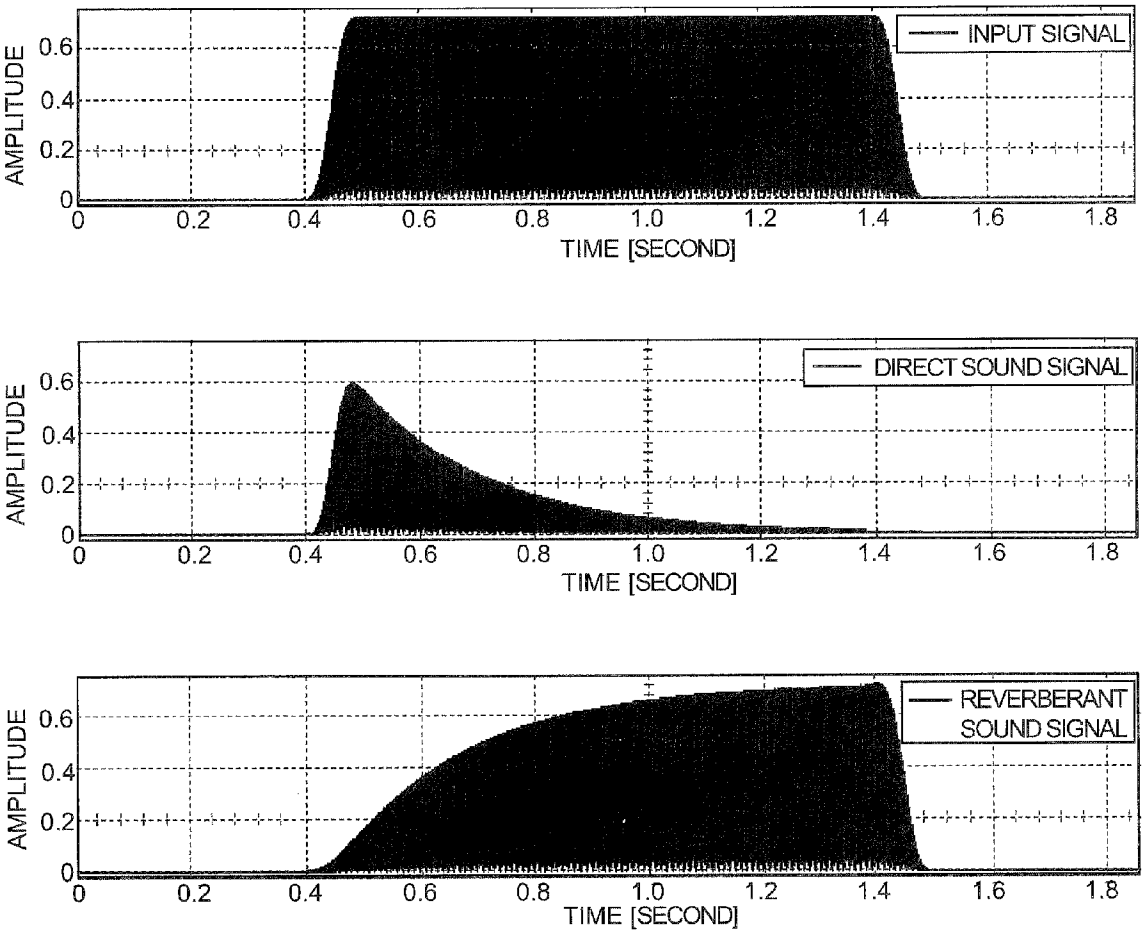
FIG. 10 is a first diagram showing, as an example, time changes of the amplitude of an input signal in an acoustic processing device, the amplitudes of a direct sound signal and a reverberant sound signal that are extracted in the acoustic processing device according to an embodiment of the present invention.
Figure 11:
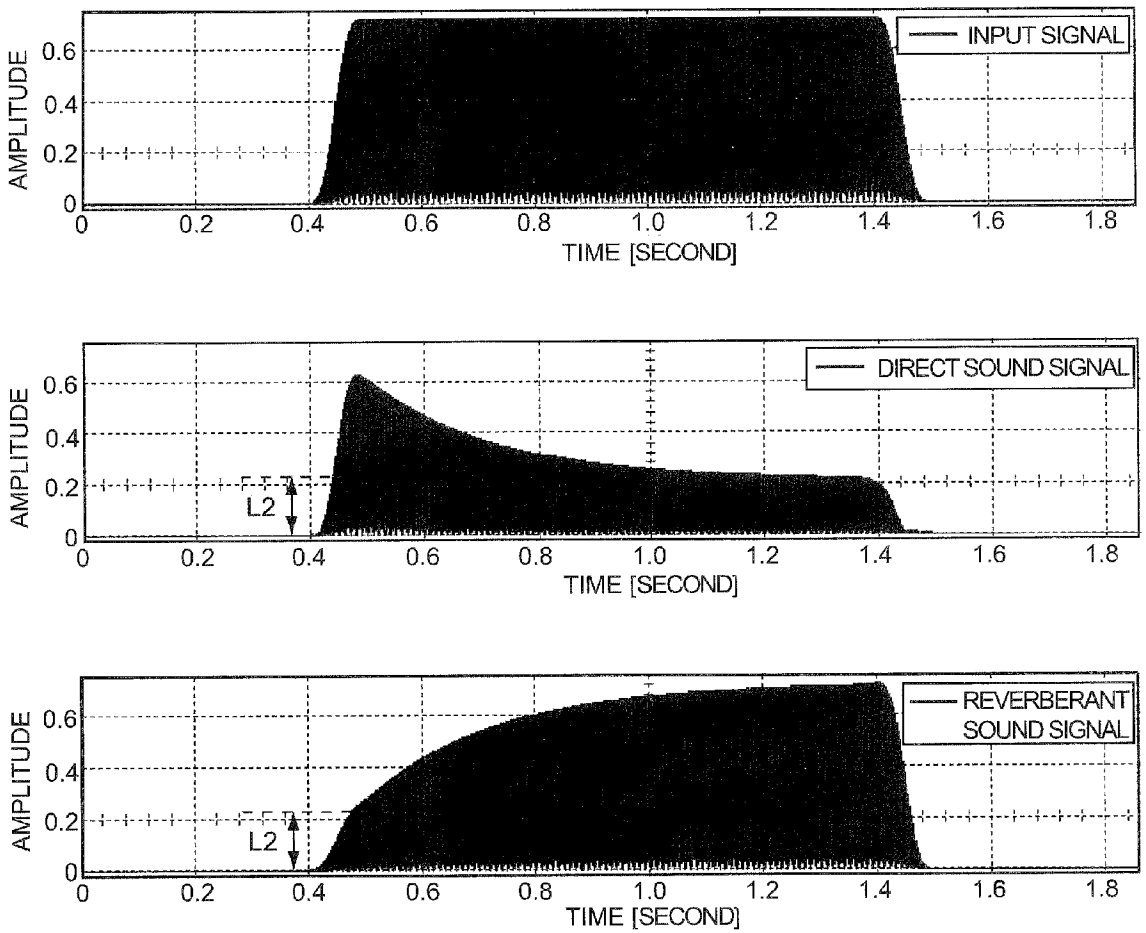
FIG. 11 is a second diagram showing, as an example, time changes of the amplitude of an input signal in an acoustic processing device, the amplitudes of a direct sound signal and a reverberant sound signal that are extracted in the acoustic processing device according to an embodiment of the present invention.
Figure 12:
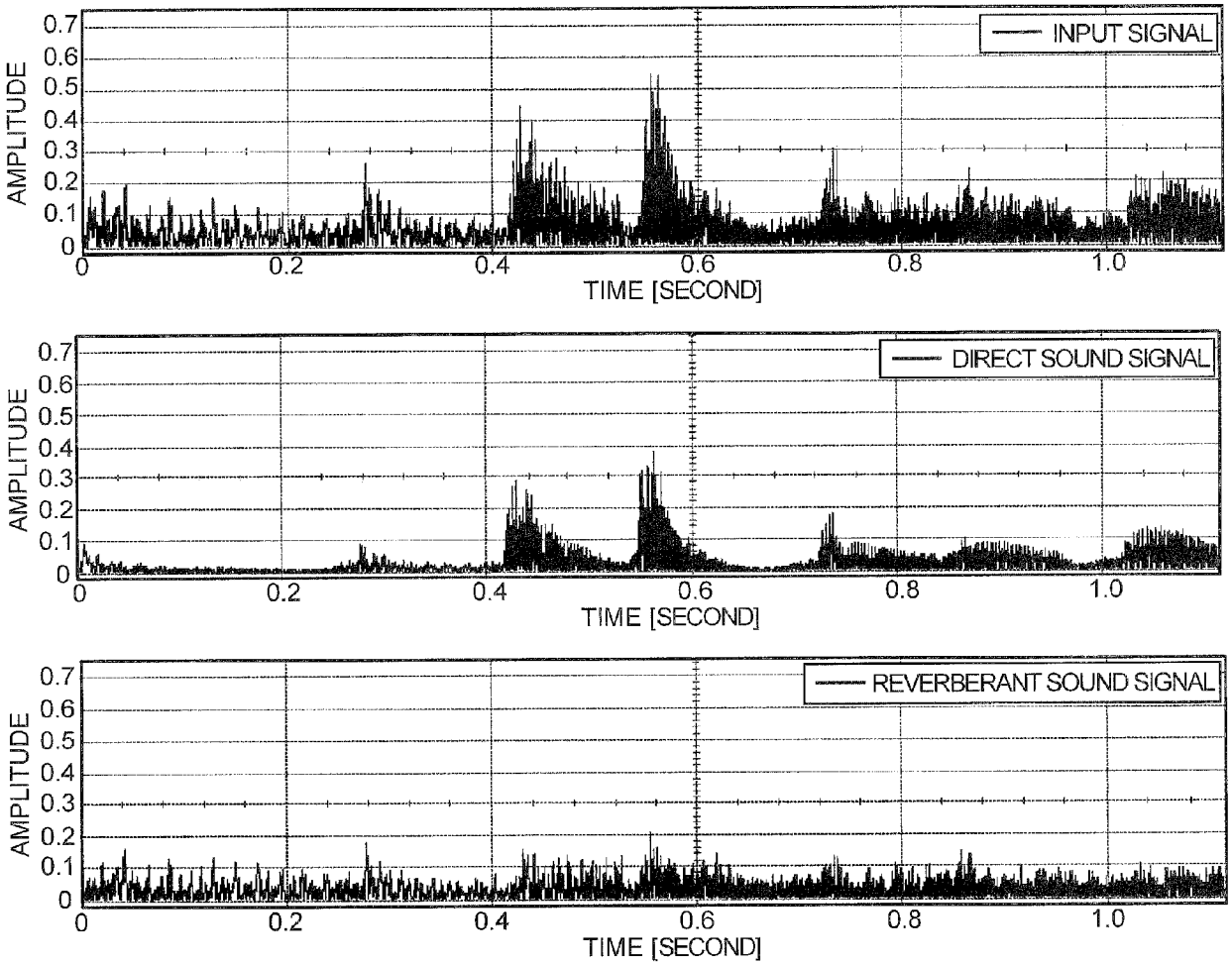
FIG. 12 is a third diagram showing, as an example, time changes of the amplitude of an input signal in an acoustic processing device, the amplitudes of a direct sound signal and a reverberant sound signal that are extracted in the acoustic processing device according to an embodiment of the present invention.
Figure 13:
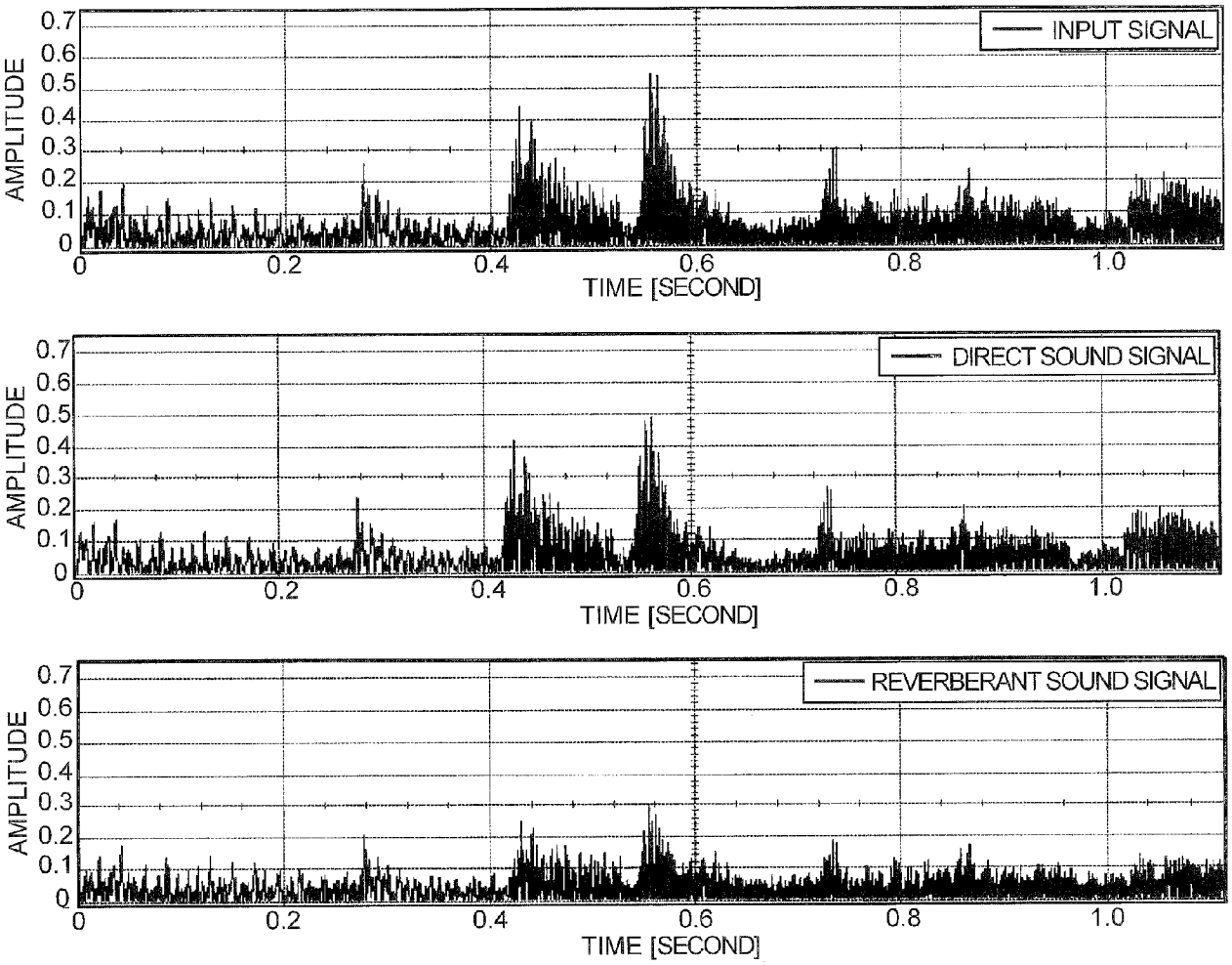
FIG. 13 is a fourth diagram showing, as an example, time changes of the amplitude of an input signal in an acoustic processing device, the amplitudes of a direct sound signal and a reverberant sound signal that are extracted in the acoustic processing device according to an embodiment of the present invention.
Figure 14:
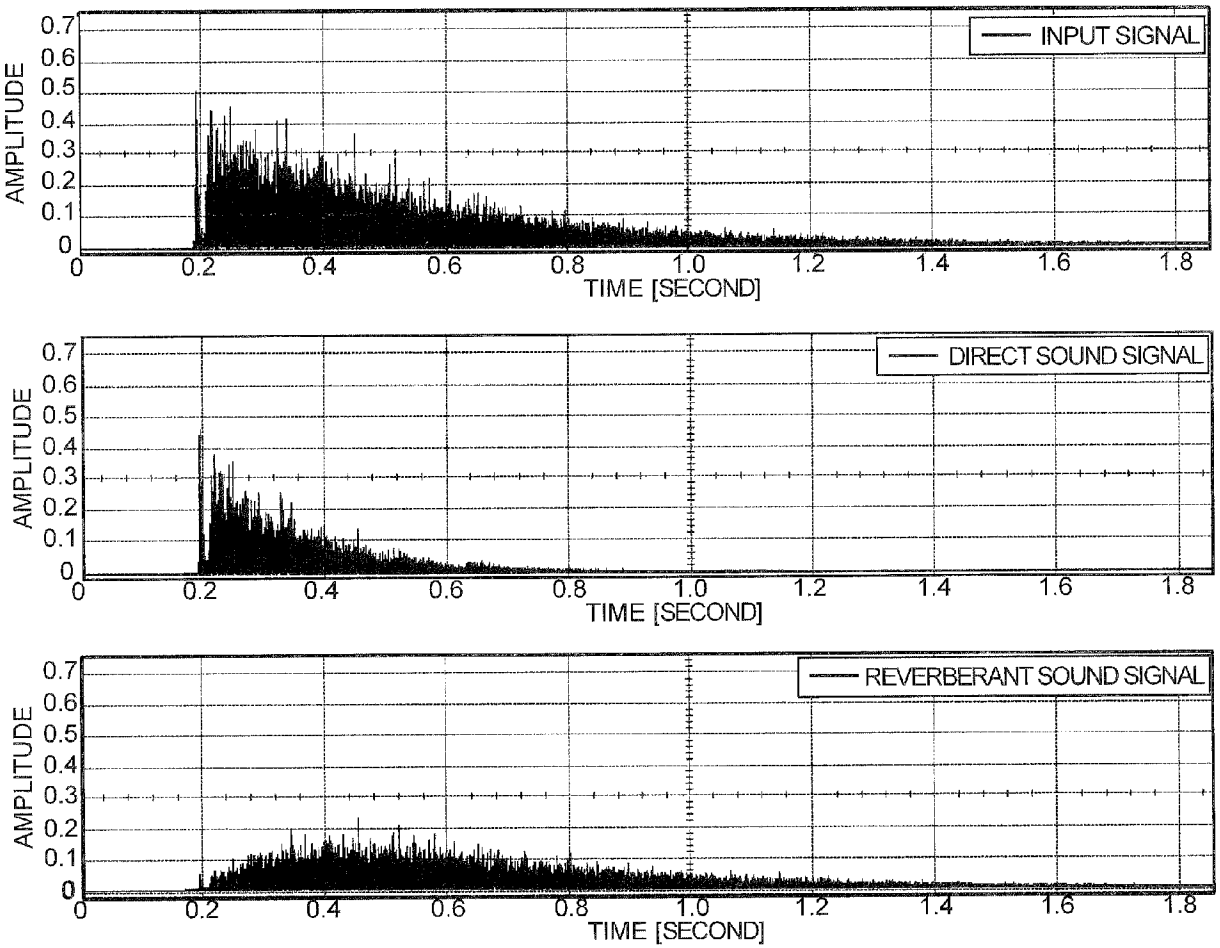
FIG. 14 is a fifth diagram showing, as an example, time changes of the amplitude of an input signal in an acoustic processing device, the amplitudes of a direct sound signal and a reverberant sound signal that are extracted in the acoustic processing device according to an embodiment of the present invention.

FIGS. 10 to 14 are diagrams showing, as an example, time changes of the amplitude of the input signal to the acoustic processing device 1, and the amplitudes of the direct sound signal and reverberant sound signal that are extracted (generated) in the acoustic processing device 1. FIGS. 10 and 11 show the case where a sine wave of 1 kHz with a reproduction time of 1 second is input as the input signal. FIGS. 12 and 13 show the case where music is input as the input signal. FIG. 14 shows the case where an impulse response in a hall (or in an environment where a reverberant sound can easily occur) is input as the input signal.

In the cases of FIGS. 10 to 14, all the normalized cutoff frequencies of the HPF unit 11 and the LPF unit 10 are 0.0082. FIGS. 10, 12, and 14 show the case where the weighting process for each spectrum is not carried out. FIGS. 11 and 13 show the case where the weighting process for each spectrum (for each frequency) is carried out.

In the cases of FIGS. 10 to 14, the inverse Fourier transform length of the IFFT units 5*a* and 5*b* is 4096 samples, the overlap length is 3840 samples, which is fifteen-sixteenths of the inverse Fourier transform length, and the window function of the inverse Fourier transform is Blackman. The same settings are true for FFT unit 3.

FIGS. 10 and 11 show the situation where, with respect to the time changes of the amplitude of the rectangular input signal, the direct sound signal, which is a non-stationary component, and the reverberant sound signal, which is a stationary component, are extracted. As opposed to the direct sound signal and reverberant sound signal shown in FIG. 10, the values of amplitudes of the direct sound signal and reverberant sound signal shown in FIG. 11 have been offset by the weighting process for each spectrum. Therefore, in an offset portion (or a portion in which the amplitudes of the direct sound signal and reverberant sound signal are raised by a height of L2 in the case of FIG. 11), a portion including a mixture of direct sound and reverberant sound is contained. In accordance with the weighting process by the first gain unit 16 and the second gain unit 17, it is possible to adjust the blend ratio of the direct sound and reverberant sound.

In FIGS. 12 and 13, with respect to the waveform of music (input signal), the waveforms that are obtained by extracting the direct sound and the reverberant sound can be confirmed. When the separated direct sound and reverberant sound are separately heard, it is possible to confirm both the direct sound and reverberant sound of the music. It is possible to aurally recognize the extraction (or separation) of the direct sound and reverberant sound.

In the case of FIG. 13, the setting of weighting for each spectrum is carried out. Therefore, the waveforms that are obtained as the reverberant sound is partially added in the direct sound and as the direct sound is partially added in the reverberant sound can be confirmed (The heights of amplitudes of the direct sound signal and reverberant sound signal in FIG. 13 are higher than in FIG. 12). Therefore, it is confirmed that the blend ratio of the direct sound and reverberant sound can be adjusted by the setting of weighting for each spectrum. Even if the direct sound and reverberant sound shown in FIG. 13 are heard, an output sound into which the direct sound and the reverberant sound have been blended according to the blend ratio can be confirmed.

In the case of FIG. 14, an impulse response in a hall is input as the input signal. Because of the impulse response, there is an output at a time when a very short signal is input, and the output has a property of converging in amplitude for a short period of time. However, because of the impulse response in the hall that is an environment where a reverberant sound can easily occur, in addition to the direct sound, a lot of reverberant sound would be contained.

In FIG. 14, the following can be confirmed: a direct sound whose amplitude has converged for a shorter period of time than the convergence of the amplitude of the input signal; and a reverberant sound whose amplitude has been maintained for a longer period of time than the convergence of the amplitude of the direct sound. In the case of FIG. 14, the normalized cutoff frequencies of the HPF unit 11 and the LPF unit 10 are set to 0.0082. However, by adjusting the values of the normalized cutoff frequencies, it is possible to adjust the extraction time of the direct sound and the extraction time of the reverberant sound.

Figure 15:
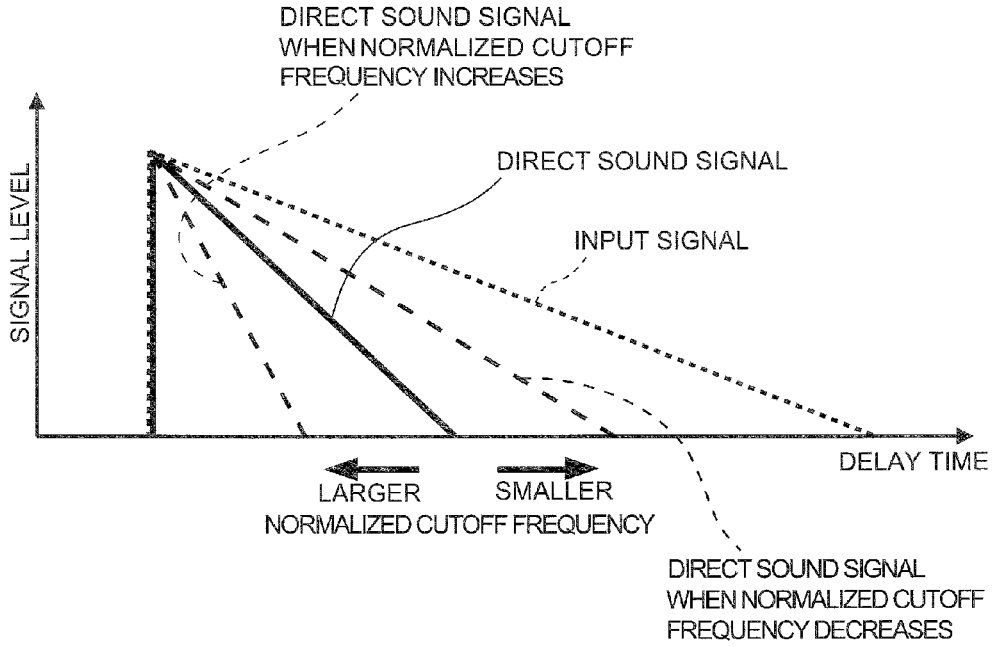
FIG. 15(*a*) is a diagram schematically showing a state in which the waveform of a direct sound signal shown in FIG. 14 varies according to how the value of a normalized cutoff frequency is adjusted, and an input signal.
Figure 15:
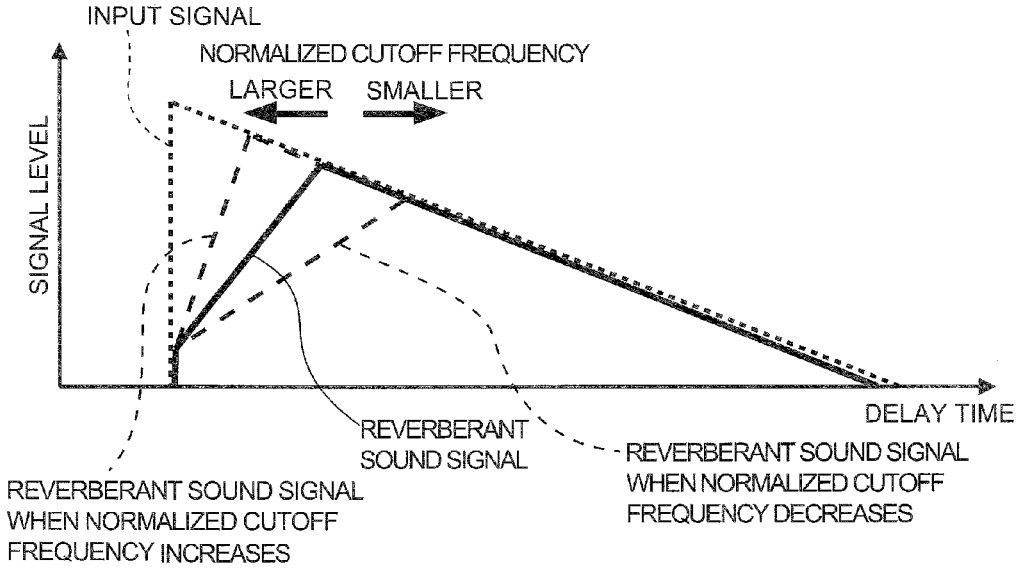

FIG. 15(*a*) is a diagram schematically showing a state in which the waveform of the direct sound shown in FIG. 14 varies according to how the value of a normalized cutoff frequency is adjusted, and the input signal. As shown in FIG. 15(*a*), as the value of the normalized cutoff frequency becomes larger, the time required for the amplitude of the impulse response to converge becomes shorter. As the value of the normalized cutoff frequency becomes smaller, the time required for the amplitude of the impulse response to converge becomes longer, showing the shape of waveform that is close to the converged state of the amplitude of the input signal.

In that manner, by adjusting the value of the normalized cutoff frequency, it is possible to change the extraction time of the direct sound in the input signal. Accordingly, as the value of the normalized cutoff frequency is decreased, the extraction time of the direct sound in the input signal becomes longer, enabling extraction of the direct sound in such a way as to contain not only a non-stationary sound but also a stationary sound. For example, to an extent shown in FIG. 14, the extraction of the direct sound containing the stationary sound is carried out. Therefore, compared with the direct sound that does not contain a stationary sound at all, it is possible to add such properties as tone colors and ease of listening to the direct sound. When a listener listens to the direct sound, the listener can recognize the direct sound as a sound without a feeling of strangeness.

FIG. 15(*b*) is a diagram schematically showing a state in which the waveform of the reverberant sound shown in FIG. 14 varies according to how the value of a normalized cutoff frequency is adjusted, and the input signal. As shown in FIG. 15(*b*), as the value of the normalized cutoff frequency becomes larger, the amplitude of the reverberant sound begins to increase early on, and the increase in the amplitude of the reverberant sound tends to dramatically rise early on. As the value of the normalized cutoff frequency becomes smaller, the increase in the amplitude of the reverberant sound (or a rising portion) becomes gradual.

Accordingly, by adjusting the value of the normalized cutoff frequency, it is possible to change the extraction time of the direct sound in the input signal. By decreasing the value of the normalized cutoff frequency, it is possible to reduce the effects of the direct sound contained in the reverberant sound signal. By increasing the value of the normalized cutoff frequency, it is possible to extract the reverberant sound signal that contains a small amount of direct sound.

Although the present invention has been described in detail with the reference to the accompanying drawings, the direct sound extraction device and reverberant sound extraction device of the present invention are not limited to the above embodiment. It will be apparent to those having ordinary skill in the art that a number of modifications or alternations to the invention as described herein may be made. All such modifications or alternations should therefore be seen as within the scope of the present invention.

By utilizing the direct sound extraction device and reverberant sound extraction device of the present invention, it is also possible to build various acoustic environments. For example, from an input signal that includes a reverberant sound in a direct sound, a direct sound signal is extracted by the direct sound extraction device; the direct sound signal is output from a speaker, which is placed near a listener. As a result, compared with the case where the input signal is output from a speaker without being changed, it is possible to make a vocal sound clearer, thereby making it possible for the listener to easily listen. Moreover, a reverberant sound signal is extracted by the reverberant sound extraction device from the input signal; and the reverberant sound signal is output from a speaker, which is placed distant from the listener. As a result, it is possible to output the reverberant sound in an effective manner.

REFERENCE SINGS LIST

1: acoustic processing device (direct sound extraction device and reverberant sound extraction device)

3: FFT unit (Fourier transform unit and spectrum transform unit)

4: frequency spectrum region filtering unit

5*a*, 5*b*: IFFT unit (inverse Fourier transform unit and inverse spectrum transform unit)

10: LPF unit (low-pass filter unit)

11: HPF unit (high-pass filter unit)

12: first limiter unit

13: second limiter unit

14: third limiter unit

15: fourth limiter unit

16: first gain unit

17: second gain unit

18: first subtraction unit

19: second subtraction unit

L, R: input signal

Lfa, Rfa: amplitude spectrum signal

Lfp, Rfp: phase spectrum signal

Lfa1: integral signal

Lfa2: differential signal

Lfd, Ld, Rfd, Rd: direct sound signal

Lfr, Lr, Rfr, Rr: reverberant sound signal

The invention claimed is:

1. A direct sound extraction device, comprising:

a Fourier transform unit which performs a Fourier transform process on an input signal that includes a reverberant sound in a direct sound;

a spectrum transform unit which transforms, on the basis of frequency spectra of real and imaginary numbers of the input signal on which a Fourier transform process has been performed by the Fourier transform unit, the input signal to a first amplitude spectrum signal and a phase spectrum signal;

a low-pass filter unit which carries out a low-pass filtering process on the first amplitude spectrum signal by using a preset normalized cutoff frequency for each frequency;

a first limiter unit which limits a negative side of an amplitude of a second amplitude spectrum signal on which a low-pass filtering process has been performed by the low-pass filter unit, so as to bring the amplitude to zero;

a first subtraction unit which calculates a third amplitude spectrum signal by subtracting the second amplitude spectrum signal whose negative-side amplitude has been limited by the first limiter unit from the first amplitude spectrum signal;

a second limiter unit which limits a negative side of an amplitude of the third amplitude spectrum signal calculated by the first subtraction unit, so as to bring the amplitude to zero;

an inverse spectrum transform unit which calculates, on the basis of the phase spectrum signal and the third amplitude spectrum signal whose negative-side amplitude has been limited by the second limiter unit, a signal that is made from frequency spectra of real and imaginary numbers; and an inverse Fourier transform unit which performs an inverse Fourier transform process on the signal calculated by the inverse spectrum transform unit to generate a direct sound signal that is obtained by extracting the direct sound from the input signal.

2. The direct sound extraction device according to claim 1, comprising a first gain unit which performs weighting of the second amplitude spectrum signal by amplifying or attenuating, for each frequency, an amplitude of the second amplitude spectrum signal whose negative-side amplitude has been limited by the first limiter unit, wherein the inverse spectrum transform unit calculates, on the basis of the phase spectrum signal and the weighted second amplitude spectrum signal weighted by the first gain unit, a signal that is made from frequency spectra of real and imaginary numbers.

3. A reverberant sound extraction device, comprising:

a Fourier transform unit which performs a Fourier transform process on an input signal that includes a reverberant sound in a direct sound;

a spectrum transform unit which transforms, on the basis of frequency spectra of real and imaginary numbers of the input signal on which a Fourier transform process has been performed by the Fourier transform unit, the input signal to a first amplitude spectrum signal and a phase spectrum signal;

a high-pass filter unit which carries out a high-pass filtering process on the first amplitude spectrum signal by using a preset normalized cutoff frequency for each frequency;

a limiter unit which limits a negative side of an amplitude of a filtered amplitude spectrum signal on which a high-pass filtering process has been performed by the high-pass filter unit, so as to bring the amplitude to zero;

a subtraction unit which calculates a subtracted amplitude spectrum signal by subtracting the filtered amplitude spectrum signal whose negative-side amplitude has been limited by the limiter unit from the first amplitude spectrum signal;

an additional limiter unit which limits a negative side of an amplitude of the subtracted amplitude spectrum signal calculated by the subtraction unit, so as to bring the amplitude to zero;

an inverse spectrum transform unit which calculates, on the basis of the phase spectrum signal and the subtracted amplitude spectrum signal whose negative-side amplitude has been limited by the additional limiter unit, a signal that is made from frequency spectra of real and imaginary numbers; and an inverse Fourier transform unit which performs an inverse Fourier transform process on the signal calculated by the inverse spectrum transform unit to generate a reverberant sound signal that is obtained by extracting the reverberant sound from the input signal.

4. The reverberant sound extraction device according to claim 3, comprising a gain unit which performs weighting of the filtered amplitude spectrum signal by amplifying or attenuating, for each frequency, an amplitude of the filtered amplitude spectrum signal whose negative-side amplitude has been limited by the limiter unit, wherein the inverse spectrum transform unit calculates, on the basis of the phase spectrum signal and a weighted amplitude spectrum signal weighted by the gain unit, a signal that is made from frequency spectra of real and imaginary numbers.

* * * * *